US009200353B2

(12) United States Patent
Lee et al.

(10) Patent No.: US 9,200,353 B2
(45) Date of Patent: Dec. 1, 2015

(54) METHOD FOR MANUFACTURING AN ULTRA-HIGHSTRENGTH STEEL BAR

(75) Inventors: Sang-Youn Lee, Cheongwon-gun (KR); Hyoung-Chul Lee, Incheon (KR); Yeong-Jun Kwon, Gyeongsangbuk-do (KR)

(73) Assignee: Hyundai Steel Company, Incheon (KR)

( * ) Notice: Subject to any disclaimer, the term of this patent is extended or adjusted under 35 U.S.C. 154(b) by 343 days.

(21) Appl. No.: 13/807,274

(22) PCT Filed: Apr. 18, 2011

(86) PCT No.: PCT/KR2011/002744

§ 371 (c)(1),
(2), (4) Date: Dec. 27, 2012

(87) PCT Pub. No.: WO2012/002638

PCT Pub. Date: Jan. 5, 2012

(65) Prior Publication Data

US 2013/0098513 A1 Apr. 25, 2013

(30) Foreign Application Priority Data

Jun. 28, 2010 (KR) ..... 10-2010-0061259

(51) Int. Cl.

| | |
|---|---|
| ***C21D 8/04*** | (2006.01) |
| ***C22C 38/44*** | (2006.01) |
| ***C21D 8/06*** | (2006.01) |
| ***C21D 8/08*** | (2006.01) |
| ***C22C 38/00*** | (2006.01) |
| ***C22C 38/02*** | (2006.01) |

(Continued)

(52) U.S. Cl.

CPC . *C22C 38/44* (2013.01); *C21D 8/06* (2013.01); *C21D 8/065* (2013.01); *C21D 8/08* (2013.01); *C22C 38/001* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/60* (2013.01); *C21D 2211/005* (2013.01); *C21D 2211/008* (2013.01); *C21D 2221/10* (2013.01)

(58) Field of Classification Search

None

See application file for complete search history.

(56) References Cited

U.S. PATENT DOCUMENTS 4,016,009 A 4/1977 Economopoulos et al.
4,298,406 A * 11/1981 Brownlee et al. ..... 148/529

FOREIGN PATENT DOCUMENTS

CN 1769510 A 5/2006
JP 62-086125 U 6/1987

(Continued)

OTHER PUBLICATIONS

Machine-English translation of Korean patent 1020090043401, Hong, Suk Woo, May 6, 2009.*

(Continued)

*Primary Examiner* — Deborah Yee

(74) *Attorney, Agent, or Firm* — Mintz Levin Cohn Ferris Glovsky and Popeo, P.C.; Kongsik Kim; Joohee Lee

(57) ABSTRACT

This invention relates to an ultra-high-strength steel bar and to a method of manufacturing the same, in which the steel bar includes C: 0.05 to 0.45 wt %, Si: 0.10 to 0.35 wt %, Mn: 0.1 to 0.85 wt %, Cr: 0.6 to 1.20 wt %, and Mo: 0.05 to 0.35 wt %, with the remainder being Fe, wherein a martensite structure is formed at a surface layer and a fine ferrite structure is formed at a center layer.

5 Claims, 8 Drawing Sheets

(51) Int. Cl.

| | |
|---|---|
| ***C22C 38/04*** | (2006.01) |
| ***C22C 38/20*** | (2006.01) |
| ***C22C 38/22*** | (2006.01) |
| ***C22C 38/06*** | (2006.01) |
| ***C22C 38/24*** | (2006.01) |
| ***C22C 38/60*** | (2006.01) |

(56) References Cited

FOREIGN PATENT DOCUMENTS

| | | | |
|---|---|---|---|
| JP | 09-125143 | A | 5/1997 |
| JP | 2000-119807 | A | 4/2000 |
| JP | 2000-212691 | A | 8/2000 |
| JP | 51-99619 | B2 | 5/2013 |
| KR | 10-2009-0043401 | A | 5/2009 |
| KR | 10-2009-0132796 | A | 12/2009 |

OTHER PUBLICATIONS

Machine-English translation of Korean patent 1020090132796, Kim, Ik Whan et al., Dec. 31, 2009.*

Office Action from Chinese Patent Office for Chinese Application No. 201180035845.9, dated Apr. 11, 2014.

* cited by examiner

METHOD FOR MANUFACTURING AN ULTRA-HIGHSTRENGTH STEEL BAR

CROSS-REFERENCES TO RELATED APPLICATIONS

This application is a U.S. national phase application, pursuant to 35 U.S.C. §371, of PCT/KR2011/002744, filed Apr. 18, 2011, designating the United States, which claims priority to Korean Application No. 10-2010-0061259, filed Jun. 28, 2010. The entire contents of the aforementioned patent applications are incorporated herein by this reference.

TECHNICAL FIELD

The present invention relates to an ultra-high-strength steel bar and a method of manufacturing the same, and, more particularly, to an ultra-high-strength steel bar, which may satisfy high strength conditions including 800 MPa grade yield strength, and to a method of manufacturing the same.

BACKGROUND ART

Currently, it is essential to construct huge structures (e.g. high-rise buildings, long-span bridges, giant space structures, huge offshore structures, huge underground structures, etc.) in order to ensure the space required for human activities and the usability of space in proportion to an increase in population in future society.

As the structures in the field of civil engineering and construction become taller and more enormous, they are indispensably required to use lightweight and high strength materials.

Steel bars having 400 to 500 MPa grade yield strength are presently commercially used in the construction of high-rise structures, and such a trend is expected to further accelerate in the future.

DISCLOSURE

Technical Problem

An object of the present invention is to provide an ultra-high-strength steel bar, which may have a yield strength of 800 MPa or more, a tensile strength of 900 MPa or more, an elongation percentage of 10% or more, and no cracking upon 180° bending testing via alloy designs and control of hot rolling and cooling conditions, and a method of manufacturing the same.

Technical Solution

In order to accomplish the above object, the present invention provides an ultra-high-strength steel bar, comprising C: 0.05 to 0.45 wt %, Si: 0.10 to 0.35 wt %, Mn: 0.1 to 0.85 wt %, Cr: 0.6 to 1.20 wt %, and Mo: 0.05 to 0.35 wt %, with the remainder being Fe and other impurities, and including a surface layer and a center layer, wherein a martensite structure which is a hardening layer is formed at the surface layer and the center layer includes a ferrite structure.

The other impurities may comprise P: 0.035 wt % or less but exceeding zero, Ni: 0.2 wt % or less but exceeding zero, Cu: 0.3 wt % or less but exceeding zero, V: 0.001 to 0.006 wt %, S: 0.075 wt % or less but exceeding zero, Al: 0.04 wt % or less but exceeding zero, Sn: 0.01 wt % or less but exceeding zero, and N2: 150 ppm or less but exceeding zero.

The steel bar may have a diameter of 9.5~10.5 mm

The ferrite structure may have a grain size of 5~7 μm.

The hardening layer may have a depth of 0.8~2.3 mm from the surface toward the center.

In addition, the present invention provides a method of manufacturing an ultra-high-strength steel bar, comprising subjecting a billet for a steel bar comprising C: 0.05 to 0.45 wt %, Si: 0.10 to 0.35 wt %, Mn: 0.1 to 0.85 wt %, Cr: 0.6 to 1.20 wt %, and Mo: 0.05 to 0.35 wt %, with the remainder being Fe and other impurities, to a hot rolling process in which reheating and rough milling are performed twice and then intermediate roll-milling and finishing roll-milling are performed to manufacture a steel bar, cooling the steel bar with water up to 400 to 600° C. through a Tempcore process, and performing air cooling on a cooling bed.

The other impurities may comprise P: 0.035 wt % or less but exceeding zero, Ni: 0.2 wt % or less but exceeding zero, Cu: 0.3 wt % or less but exceeding zero, V: 0.001 to 0.006 wt %, S: 0.075 wt % or less but exceeding zero, Al: 0.04 wt % or less but exceeding zero, Sn: 0.01 wt % or less but exceeding zero, and N2: 150 ppm or less but exceeding zero.

The hot rolling process may comprise primary reheating including heating at 1000~1250° C. for 1~3 hr; primary hot rolling including rough milling at 900~1000° C.; secondary reheating including heating at 1100~1200° C. for 1~3 hr; and secondary hot rolling including rough milling, intermediate roll-milling, and finishing roll-milling at 800~900° C.

The Tempcore process may be performed by spraying cooling water under conditions of a water pressure of 4~6 bar and a spraying rate of 400~600 $m^3$/hr so that the steel bar is cooled up to 400~600° C.

The billet for the steel bar may be manufactured by performing an electric furnace process, a ladle process, and a vacuum refining process thus preparing molten steel, feeding the molten steel into a mold from a tundish via stopper casting to prevent re-oxidation, and performing continuous casting.

In the hot rolling process, a rolling ratio may be controlled so that the steel bar has a diameter of 9.5~10.5 mm.

Advantageous Effects

According to the present invention, the microstructures of a surface layer and a center layer can be controlled by means of alloy designs having Cr and Mo, the control of a rolling ratio via hot rolling, a Tempcore process, etc., thus producing ultra-high-strength steel bars which satisfy a yield strength of 800 MPa or more, a tensile strength of 900 MPa or more, an elongation percentage of 10% or more, and 180° bending testing.

Because such steel bars can satisfy conditions including yield strength, tensile strength, elongation percentage and bending testing, which were conventionally unsatisfactory, they can be combined with high-strength concrete [σck (concrete strength)=600~1200 kg/$cm^2$] and a column bar and thus can be effectively utilized in main bars or shear-reinforcing bars.

In particular, the present invention can introduce advanced Korean iron and steel technology and can greatly contribute to the future of civil engineering and construction technology.

MODE FOR INVENTION

Figure 1:
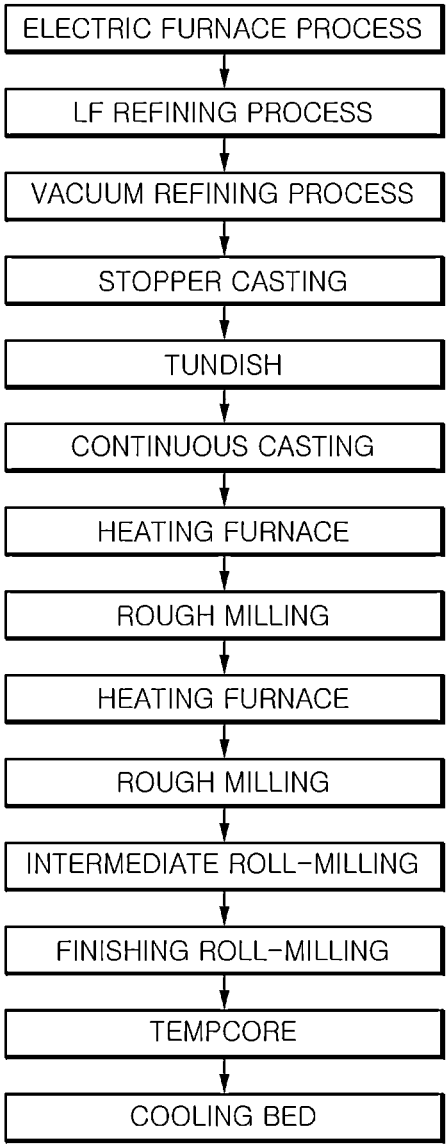
FIG. 1 is a flowchart illustrating a process of manufacturing an ultra-high-strength steel bar according to the present invention.

Hereinafter, a detailed description will be given of the present invention.

According to the present invention, the steel bar comprises C: 0.05 to 0.45 wt %, Si: 0.10 to 0.35 wt %, Mn: 0.1 to 0.85 wt %, Cr: 0.6 to 1.20 wt %, and Mo: 0.05 to 0.35 wt %, with the remainder being Fe and other impurities.

The other impurities comprise P: 0.035 wt % or less but exceeding zero, Ni: 0.2 wt % or less but exceeding zero, Cu: 0.3 wt % or less but exceeding zero, V: 0.001~0.006 wt %, S: 0.075 wt % or less but exceeding zero, Al: 0.04 wt % or less but exceeding zero, Sn: 0.01 wt % or less but exceeding zero, and N2: 150 ppm or less but exceeding zero.

From the alloy composition as above, billets for steel bars are produced, after which reheating and rough milling are performed twice, followed by conducting intermediate roll-milling and finishing roll-milling to manufacture steel bars, cooling the steel bars with water through a Tempcore process, and air cooling them on a cooling bed, resulting in ultra-high-strength steel bars which satisfy a yield strength of 800 MPa or more, a tensile strength of 900 MPa or more, an elongation percentage of 10% or more, and properties of 180° bending testing.

The steel bars have a diameter of 10 mm, which are represented by D10. However, taking into consideration the error margin of the manufacturing process, D10 may be set to the range of 9.5~10.5 mm Also, steel bars having a diameter of 13 mm are represented by D13, and steel bars having a diameter of 16 mm are represented by D16, and furthermore, taking into consideration the error margin of the manufacturing process, D13 may be set to the range of 12.5~13.5 mm, and D16 may be set to the range of 15.5~16.5 mm More specifically, in order to increase hardenability and resistance to tempering embrittlement, Cr and Mo are added, and reheating and rough milling of the billets for steel bars are performed twice, thus reducing an initial austenite grain size, and furthermore, a Tempcore process and air cooling on a cooling bed are carried out, thereby obtaining a final structure having fine grains.

The addition of Cr and Mo enlarges an austenite region in a phase diagram and decreases a transformation temperature. Also in the TTT curve, the cover S which shows the martensite boundary is wholly shifted rightward, so that the zone where martensite is produced is enlarged, thus increasing hardenability.

When reheating and rough milling are performed twice, the initial austenite grain size may decrease. The production of steel bars of D10 enables austenite grains to be much finer, whereby a final structure becomes fine.

A Tempcore process enables the surface layer to be hardened via accelerated cooling, thus increasing yield strength and hardness.

The final structure of the manufactured steel bars is configured such that the surface layer has a fine and dense martensite structure and the center layer has a fine ferrite structure. As such, ferrite has a grain size of 5~7 μm and the depth of a hardening layer is 0.8~2.3 mm. The steel bars are D10.

The functions and amounts of alloy elements of the present invention are described below.

[Essential Elements]

C: 0.05 to 0.45 wt %

C is added to ensure strength. If the amount of C is less than 0.05 wt %, it is difficult to ensure desired strength corresponding to a yield strength of 800 MPa or more. In contrast, if the amount thereof exceeds 0.45 wt %, in a Tempcore process, the hardening layer may have increased hardness and high strength but may become brittle, undesirably remarkably lowering bending performance.

Si: 0.10 to 0.35 wt %

Si is added to remove oxygen from steel in a steel making process and may exhibit solid solution strengthening effects. If the amount of Si is less than 0.10 wt %, solid solution strengthening effects may become insufficient. In contrast, if the amount thereof exceeds 0.35 wt %, a carbon equivalent may increase, undesirably deteriorating weldability and toughness.

Mn: 0.1 to 0.85 wt %

Mn is added to increase strength and toughness, and functions to stabilize austenite and to increase quenchability. Also this component decreases the Ar3 temperature and thus may widen the temperature range of the rolling process according to the present invention, thereby remarkably lowering the grain size via rolling, ultimately increasing strength and toughness.

If the amount of Mn is less than 0.1 wt %, it does not contribute to strength enhancement. In contrast, if the amount thereof exceeds 0.85 wt %, the manufacturing cost may increase and toughness may decrease and a carbon equivalent may increase, undesirably deteriorating weldability.

Cr: 0.6 to 1.20 wt %

Cr is added to enlarge an austenite region and is combined with C, thus forming a carbide which does not cause embrittlement. In the present invention, Cr is added to increase hardenability in order to achieve 800 MPa grade yield strength.

If the amount of Cr is less than 0.6 wt %, the strength enhancing effect is insignificant. In contrast, if the amount thereof exceeds 1.20 wt %, hardenability may excessively increase, undesirably reducing a transformation rate of ferrite upon rolling and cooling and deteriorating the quality upon welding.

Mo: 0.05 to 0.35 wt %

Mo is added to increase hardenability.

If the amount of Mo is less than 0.05 wt %, the strength enhancing effect is insignificant. In contrast, if the amount thereof exceeds 0.35 wt %, hardenability may excessively increase, undesirably reducing a transformation rate of ferrite upon rolling and cooling and deteriorating the quality upon welding, as in Cr.

[Other Impurities]

Among the other impurities, P, Ni, Cu, and S are added because of the steel characteristics of an electric furnace process, and V may be arbitrarily added.

P: 0.035 wt % or less but exceeding zero

In the case when P is uniformly distributed in steel, additional problems do not occur and solid solution strengthening effects are exhibited. However, this component decreases processability while being present in a state of a sulfide or grain boundary segregation.

Thus, P is added in as small an amount as possible. However, P is an inevitable impurity in terms of steel characteristics of an electric furnace process, and the amount thereof is limited to 0.035 wt % or less.

Ni: 0.2 wt % or less but exceeding zero

Ni increases hardenability and toughness. However, if the amount thereof exceeds 0.2 wt %, a continuous casting process becomes difficult and the manufacturing cost may increase due to the addition of an expensive alloy element.

Cu: 0.3 wt % or less but exceeding zero

Cu is added to enhance strength due to solid solution strengthening effects. However, if the amount thereof exceeds 0.3 wt %, toughness may remarkably decrease, and processability and weldability may deteriorate.

V: 0.001 to 0.006 wt %

V may be added in an amount of 0.001 to 0.006 wt % to ensure strength via solid solution strengthening and precipitation strengthening. However, this component may not be added.

S: 0.075 wt % or less but exceeding zero

S is combined with Mn to improve machinability of steel. However, if the amount thereof exceeds 0.075 wt %, processability may decrease, thus causing cracking upon rolling.

Al: 0.04 wt % or less but exceeding zero

Al is added to remove oxygen from molten steel. However, if the amount of Al exceeds 0.04 wt %, $Al_2O_3$ which is a nonmetallic inclusion is formed, thus decreasing impact toughness.

Sn: 0.01 wt % or less but exceeding zero

Sn is present as an impurity which is not removable in a steel making process using iron scraps. Sn may exhibit solid solution strengthening effects but may undesirably decrease strength and an elongation percentage.

If the amount of Sn exceeds 0.01 wt %, an elongation percentage and molding values may drastically decrease.

N2: 150 ppm or less but exceeding zero

N is combined with C and V thus forming a carbide. When the amount thereof is equal to or higher than 10 ppm, growth of grains may be suppressed upon rolling, so that the grains are made fine, thus increasing strength and toughness. However, if the amount thereof exceeds 150 ppm, an elongation percentage and transformation properties upon hot rolling may undesirably decrease.

In the present invention, the above components are contained, and the remainder is Fe, and there may be subtle incorporation of inevitable impurities as elements contained depending on conditions of feeds, materials, manufacturing equipment, etc.

The above components are subjected to a steel making process, thus preparing molten steel which is then subjected to a continuous casting process to produce billets for steel bars, followed by performing a series of processes of reheating, hot rolling (rough milling), reheating, hot rolling (rough milling, intermediate roll-milling, finishing roll-milling), and Tempcore, thereby manufacturing steel bars.

With reference to FIG. 1, the steel making process includes an electric furnace process, an LF refining process, and a vacuum refining process. In the electric furnace process, the amounts of hydrogen (H), oxygen (O), and nitrogen (N) are adjusted to reduce a nonmetallic inclusion, and in the vacuum refining process following the LF refining process (LF: Ladle Furnace), degassing treatment is carried out, thus removing H, O and N which cause defects of strands.

The LF refining process is applied to achieve desulfurization of molten steel, deoxidation, control of shape of a nonmetallic inclusion, control of the components and temperatures, etc.

After the vacuum refining process, stopper casting is performed, so that the molten steel is fed into a mold from a tundish. The stopper casting is conducted by applying an immersion nozzle or a shredder to the tundish, and upon feeding the molten steel into the mold from the tundish, an oxygen-free process which blocks contact between the molten steel and the air is performed.

When the contact between the molten steel and the air is blocked upon feeding the molten steel into the mold, contamination of the molten steel due to the inclusion in steel is minimized upon manufacturing billets for steel bars, and re-oxidation of the molten steel is prevented, thus increasing the quality of final products. The shredder is a kind of pipe which is provided between the tundish and the mold to prevent the contact of the molten steel with the air.

The molten steel fed into the mold is continuously cast thus obtaining billets, which are semi-finished products for manufacturing steel bars.

In order to manufacture the steel bars from the billets obtained via continuous casting, reheating and rough milling are performed twice. Subsequently, intermediate roll-milling and finishing roll-milling are performed to produce steel bars, which are then subjected to a Tempcore process and a cooling bed process, thus obtaining desired mechanical properties.

When reheating and rough milling are performed twice and then intermediate roll-milling and finishing roll-milling are conducted as mentioned above, the initial austenite grain size is decreased to be smaller as possible, so that ferrite grains are made fine.

Figure 2:
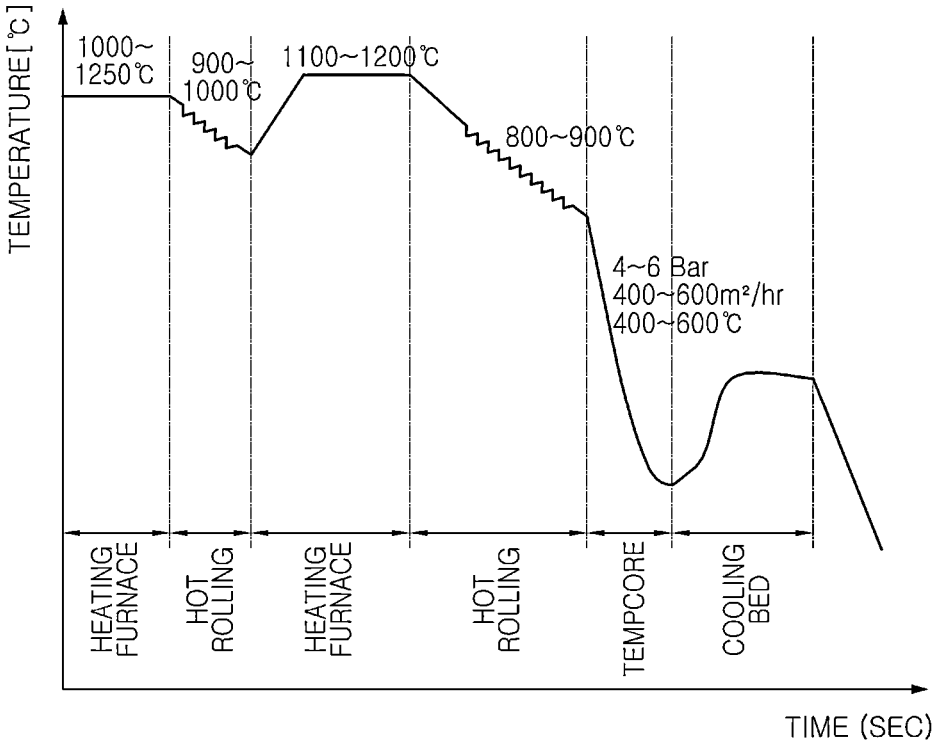
FIG. 2 illustrates a heat treatment process in the process of manufacturing an ultra-high-strength steel bar according to the present invention.

FIG. 2 illustrates a heat treatment process in the process of manufacturing the ultra-high-strength steel bar according to the present invention.

With reference to FIG. 2, the manufacturing method is specified below.

[Heating Furnace]_Primary Reheating

The segregated components upon casting of billets for steel bars are dissolved thus forming homogeneous austenite. As such, in order to decrease the initial austenite grain size, primary reheating is performed at 1000~1250° C. for 1~3 hr.

If the primary reheating temperature is lower than 1000° C., the segregated components are not dissolved. In contrast, if it is higher than 1250° C., it is difficult to decrease the initial austenite grain size. The reheating time is preferably 1~3 hr to form homogeneous austenite. If the reheating time exceeds 3 hr, austenite grains may become coarse.

[Hot Rolling]_Primary Rough Milling

Primary rough rolling is performed at 900~1000° C. so that the homogeneous austenite structure becomes fine. When the primary rough milling is conducted in this way, the austenite grain size is drastically decreased via rolling in recrystallized austenite, compared to the austenite grain size upon primary reheating. Thereby, the austenite grain boundary which is a place when ferrite nuclei are produced may increase.

The primary rough milling is performed at 900° C. or higher to avoid rolling in two phase regions, and the upper limit thereof is set to 1000° C. in consideration of the primary reheating temperature.

In this embodiment, the primary rough milling is performed through a grooved roll.

[Reheating]_Secondary Reheating

To increase hardenability, strength and rollability, secondary reheating is carried out at 1100~1200° C. for 1~3 hr.

The secondary reheating is conducted at 1100° C. or higher to increase rollability, and its temperature does not exceed 1200° C. so that fine austenite grains obtained via the primary reheating and the primary rough milling may not become coarse. The secondary reheating time is preferably set to 1~3 hr to increase rollability. If this process time is longer than 3 hr, austenite grains become coarse, making it difficult to ensure strength.

[Hot Rolling]_Secondary Rough Milling Intermediate Roll-Milling, Finishing Roll-Milling The billets subjected to secondary reheating undergo hot rolling including secondary rough milling, intermediate roll-milling and finishing roll-milling, thus producing steel bars.

Upon secondary rough milling, the fine austenite grains obtained via the primary rough milling are made smaller, so that the initial austenite grains become fine, and these grains are elongated via intermediate roll-milling and finishing roll-milling, resulting in much finer austenite.

The finishing roll-milling temperature, that is, the secondary hot rolling finishing temperature, is 800~900° C. so as to obtain a fine structure after hot rolling If the hot rolling finishing temperature is lower than 800° C., rolling rate problems may occur, productivity may decrease, and cracking may be incurred upon bending. In contrast, if this temperature exceeds 900° C., austenite grains grow in size, making it difficult to obtain fine grains, and strength enhancing effects may become insignificant.

The hot rolling is performed in the range of D16~D10. That is, the rolling ratio is increased from D16 toward D10. As the rolling ratio is increased, the deformation rate is increased and thereby the austenite structure may become fine, thus increasing yield strength. Herein, D16~D10 indicate the thickness of steel bars, that is, diameter.

[Tempcore Process]

A Tempcore process is performed by spraying cooling water at high pressure onto the surface layer of the hot-rolled steel bars in order to obtain a final desired structure of steel bars, under conditions of a water pressure of 4~6 bar, a spraying rate of 420~500 $m^3$/hr, so that the steel bars are cooled up to 400~600° C.

Such a Tempcore process is a heat treatment process in which the surface layer of a steel bar is transformed into a high-strength structure, that is, martensite, and then a hardening structure is annealed by heat inside the steel bar. After the Tempcore process, the center layer has an austenite structure and is transformed into a fine ferrite structure via a cooling bed process.

Figure 8:
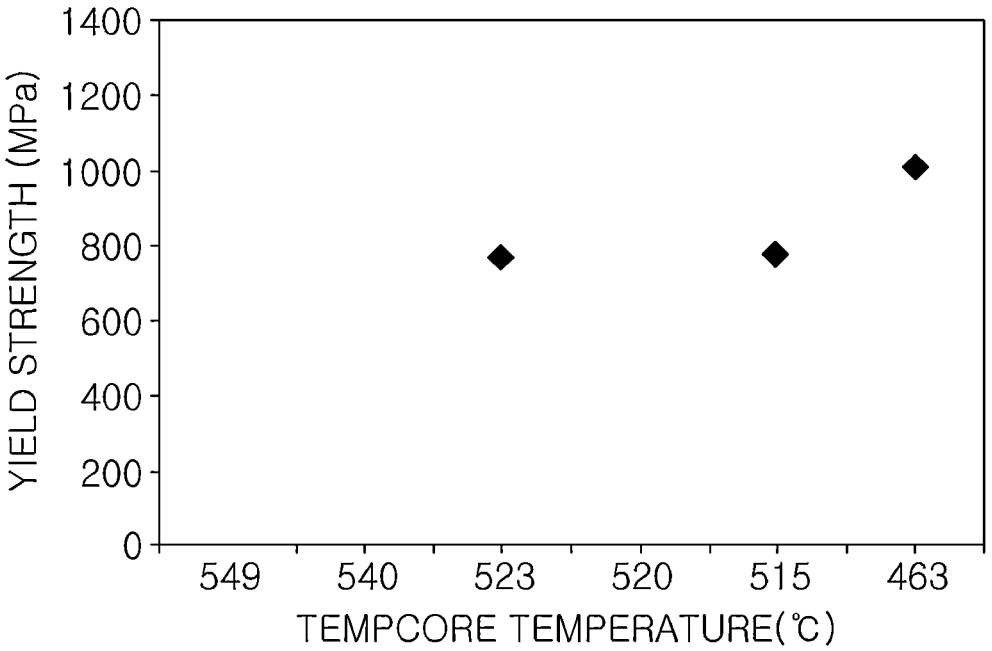
FIG. 8 is a graph illustrating the results of measuring changes in yield strength depending on the temperature of a Tempcore process.

In the Tempcore process, the preferred cooling temperature is 463° C. As shown in FIG. 8, high yield strength is obtained at 463° C.

[Cooling Bed]

After the Tempcore process, air cooling is performed to remove internal stress, thus stabilizing the structure of the hardening layer. The final structure of the steel bars cooled after the Tempcore process is configured such that the surface layer has a martensite transformation structure, and the center layer has a fine ferrite structure. The ferrite structure may partially include pearlite.

The ferrite grain size of the center layer is 5~7 μm, and yield strength is 800 MPa or more. The surface layer has a hardness of 340~420 Hv, and a thickness (a depth of a hardening layer) of 0.8~2.3 mm, and the hardness of the center layer is 250~350 Hv. When the surface layer and the center layer are rolled into D10, there is a difference in hardness of about 50 Hv therebetween.

Although it is preferred that the ferrite grain size be as small as possible, it is difficult to ensure ferrite grains having a size of less than 5 μm. In contrast, if the size thereof exceeds 7 μm, the hardness of the center layer may decrease and thus a difference in hardness between the surface layer and the center layer may increase and the strength enhancing effect may decrease, making it difficult to satisfy a yield strength of 800 MPa or more.

As mentioned above, Cr and Mo are added, and reheating and rough milling are performed twice, after which a series of processes of intermediate roll-miffing, finishing roll-milling, Tempcore and cooling bed are carried out, thereby manufacturing ultra-high-strength steel bars which satisfy a yield strength of 800 MPa or more, a tensile strength of 900 MPa or more, an elongation percentage of 10% or more and properties of 180° bending testing.

Below is a description of the ultra-high-strength steel bar and the method of manufacturing the same through the following examples.

Table 1 below shows alloy designs of the examples according to the present invention.

TABLE 1

(Remainder: Fe, unit: wt %)

| | Kind | | | | | | | | | | | | |
|---|---|---|---|---|---|---|---|---|---|---|---|---|---|
| | C | Si | Mn | P | S | Ni | Cr | Mo | Cu | V | Al | Sn | $N_2$ (ppm) |
| Amount | 0.21 | 0.21 | 0.78 | 0.019 | 0.07 | 0.008 | 1.2 | 0.16 | 0.07 | 0.005 | 0.008 | 0.009 | 50 |

During the Tempcore process, a hardening layer which is a martensite transformation structure quenched via direct spraying of cooling water onto the surface of the steel bars is formed at the surface layer.

If the cooling temperature is lower than 400° C., embrittlement may increase. In contrast, if this temperature exceeds 600° C., it is difficult to ensure a hardening layer which is a martensite transformation structure and to obtain a yield strength of 800 MPa or more. Also, if the water pressure and the spraying rate fall out of the above ranges, it is difficult to ensure a hardening layer and to obtain yield strength.

The steel having the alloy composition of Table 1 is subjected to, as illustrated in FIG. 1, an electric furnace process, a ladle process, and a vacuum refining process to prepare molten steel, which is then fed into a mold from a tundish via stopper casting, followed by performing continuous casting, thereby manufacturing billets for steel bars.

The billets thus manufactured are subjected to reheating at 1070° C. and then primary rough milling at 950° C. After completion of the primary rough miffing, the billets are subjected to a series of processes of reheating, secondary rough milling, intermediate roll-milling, finishing roll-miffing, and Tempcore, thus manufacturing steel bars. The primary rough milling is performed through four grooved rolls (4pass).

Table 2 below shows secondary reheating, hot rolling and Tempcore conditions and mechanical properties according thereto, after the primary rough milling.

Table 2 below shows secondary reheating, hot rolling and Tempcore conditions and mechanical properties according thereto, after the primary rough milling [Class 1 indicates Example 1, and Class 2 indicates Example 2.]

Figure 4:
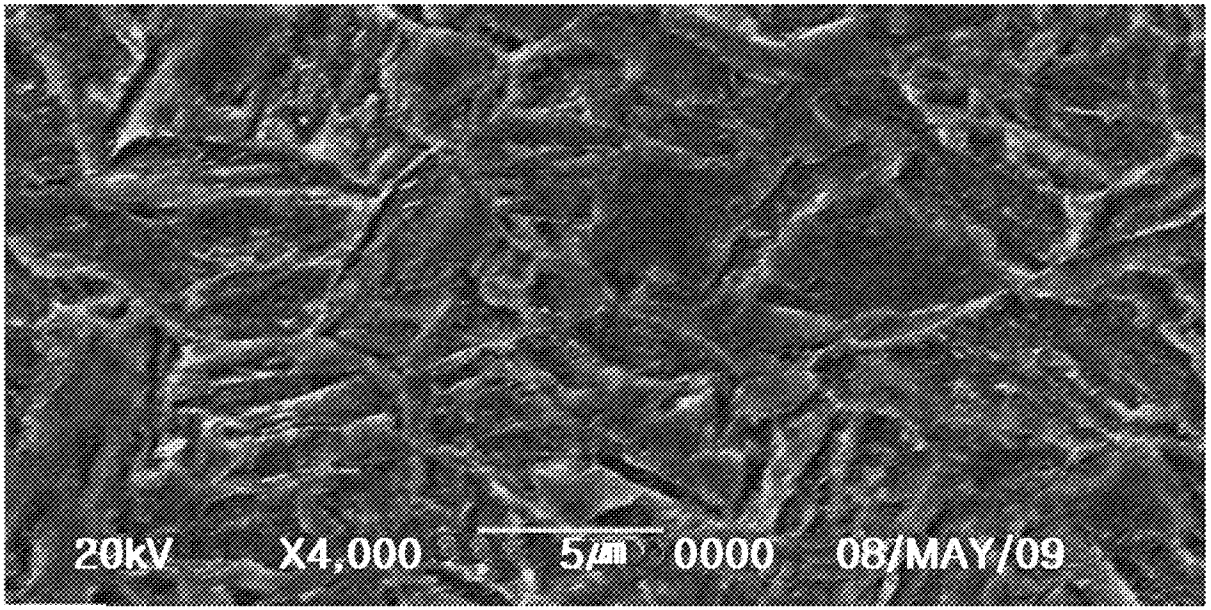
FIG. 4 illustrates a scanning electron microscope image of the microstructure of the center layer at D10 of Table 3.

As illustrated in FIG. 4, the microstructure of the center layer is observed to include ferrite grains which are long and are polygonal in shape. The ferrite grains have a size of about 5~6 μm.

Figure 5:
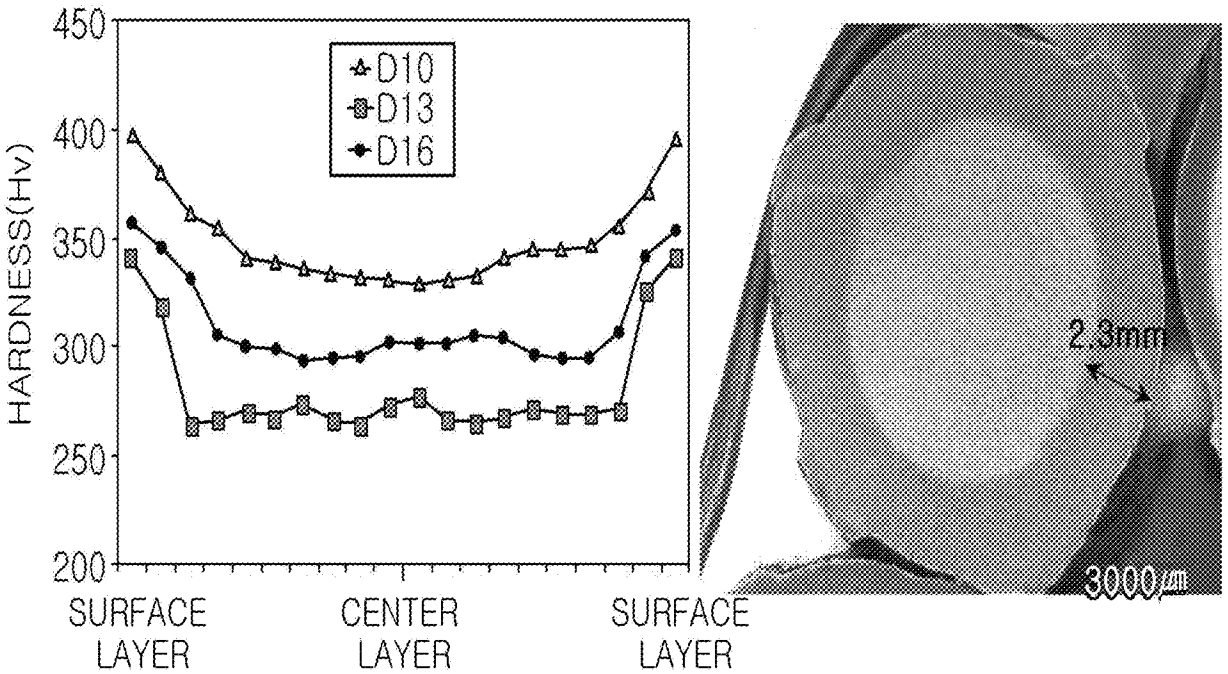
FIG. 5 illustrates (a) changes in hardness of the surface layer and the center layer at different diameters of Table 2 and (b) a cross-sectional macrostructure of a final steel bar (D10)

FIG. 5 illustrates (a) changes in hardness of the surface layer and the center layer at different diameters of Table 2 and (b) the cross-sectional macrostructure of the final steel bar (D10).

TABLE 2

| Class | Diameter | Rolling ratio | Heating furnace extraction Temp. (° C.) | Final rolling Temp. (° C.) | Rolling rate (m/sec) | Tempcore Temp. (° C.) | Water pressure (Bar) | Spraying Rate ($m^3$/hr) | Tensile strength (MPa) | Yield strength (MPa) | Elong-ation (%) | Bending test (3 d) | Bending test (5 d) | Note |
|---|---|---|---|---|---|---|---|---|---|---|---|---|---|---|
| 1 | D10 | 248S | 1170 | 890 | 16 | 610 | 5.0 | 430 | 876 | 648 | 10.3 | good | good | C. Ex. |
| 2 | D10 | 248S | 1170 | 890 | 15 | 463 | 5.0 | 430 | 1100 | 1060 | 12.6 | good | good | Invent. Ex. |
| 3 | D13 | 140S | 1170 | 890 | 15 | 561 | 5.0 | 420 | 910 | 723 | 13.5 | good | good | C. Ex. |
| 4 | D13 | 140S | 1170 | 890 | 15 | 546 | 5.0 | 460 | 888 | 701 | 13.5 | good | good | C. Ex. |
| 5 | D13 | 140S | 1170 | 890 | 14 | 528 | 5.0 | 420 | 896 | 718 | 13.5 | good | good | C. Ex. |
| 6 | D16 | 89S | 1170 | 890 | 11 | 536 | 5.0 | 470 | 914 | 722 | 10.2 | good | good | C. Ex. |
| 7 | D16 | 89S | 1170 | 890 | 11 | 523 | 5.0 | 500 | 927 | 737 | 10.9 | good | good | C. Ex. |
| 8 | D19 | — | 1170 | 947 | 8.5 | 520 | 5.0 | 950 | 893 | 825 | 9.3 | good | good | C. Ex. |
| 9 | D19 | — | 1170 | 910 | 7.5 | 410 | 5.0 | 950 | 906 | 856 | 7.6 | good | good | C. Ex. |
| 10 | D19 | — | 1170 | 870 | 6.5 | 390 | 5.0 | 950 | 1077 | 890 | 8.2 | good | good | C. Ex. |

As is apparent from Table 2 below, the case where rolling into D10 is performed satisfies a tensile strength of 900 MPa or more, a yield strength of 800 MPa or more, and an elongation percentage of 10% or more.

In Comparative Example (C.Ex) 1, satisfactory mechanical properties of tensile strength and yield strength were not obtained because of the high Tempcore process temperature despite rolling into D10. As the Tempcore process temperature was lower, yield strength increased. However, if such a temperature was excessively low, the elongation percentage also decreased.

In Comparative Examples 3 to 10, the rolling ratio was low or the Tempcore temperature was high, and thus a yield strength of 800 MPa or more could not be obtained.

Bending performance was good in all of classes 1 to 10.

Figure 3:
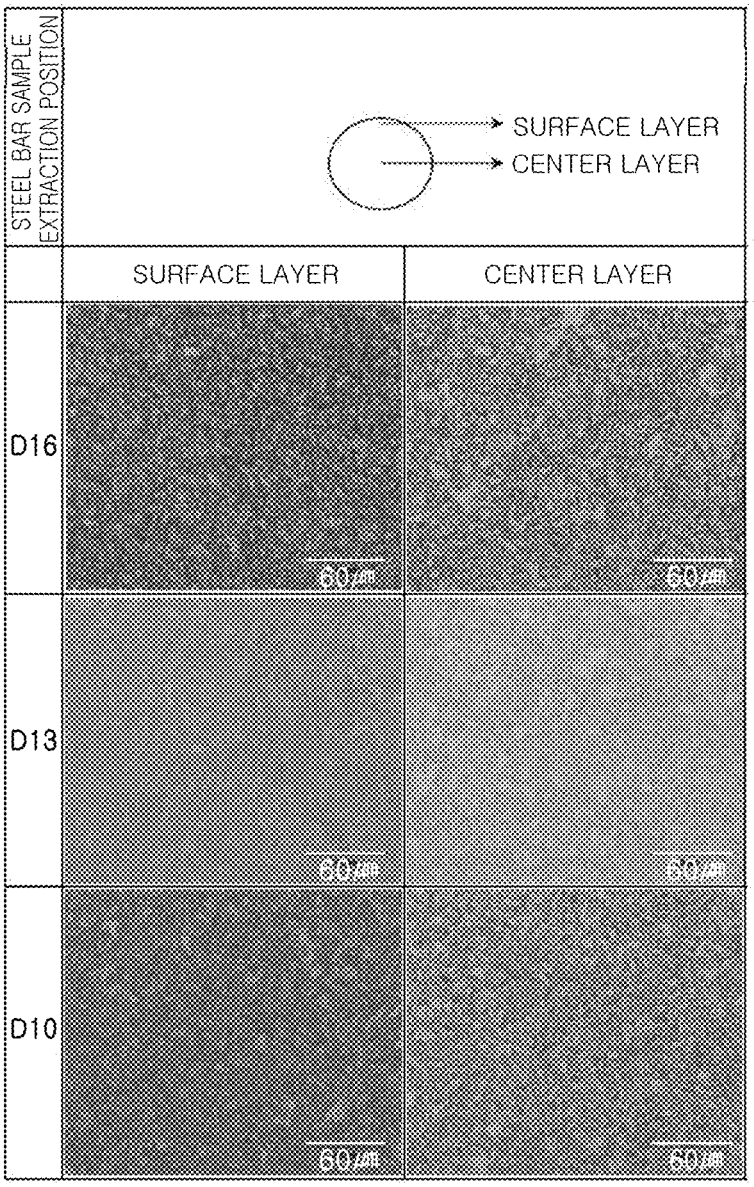
FIG. 3 illustrates optical microscope images of the microstructures of a surface layer and a center layer at different diameters of Table 2.

FIG. 3 illustrates optical microscope images illustrating the microstructures at different diameters of Table 2.

(In FIG. 3, D16 shows microscope images of the structure of Example 6 (Class 6) of Table 2, D13 shows microscope images of the structure of Example 3 (Class 3) of Table 2, and D10 shows microscope images of the structure of Example 2 (Class 2) of Table 2.) In the microscope images of FIG. 3, 60 μm represents a scale bar for showing a grain size.

As illustrated in FIG. 3, grains present in the surface layer are densely formed, and a martensite structure is observed. Particularly, as the diameter decreases from D16 to D10, the martensite structure is obviously observed. This is because, during the Tempcore process, cooling water comes into contact with the surface of a steel bar and thus the instant temperature is drastically lowered, ultimately creating the martensite transformation structure.

The center layer rolled into D10 has ferrite grains having a size of 5~7 μm, in which the ferrite grains are provided in an island shape.

FIG. 4 illustrates a scanning electron microscope image of the microstructure of the center layer at D10 of Table 3. The scanning electron microscope is used to precisely analyze the microstructure of the center layer.

(In FIG. 5(*a*), D16 corresponds to Example 6 (Class 6) of Table 2, D13 corresponds to Example 3 (Class 3) of Table 2, and D10 corresponds to Example 2 (Class 2) of Table 2.)

As illustrated in FIG. 5, as is apparent from the results of observing the cross-section, the depth of a hardening layer was 2.3 mm from the surface toward the center. The hardening layer is a zone where the martensite transformation structure is produced. Such a hardening layer is affected by Mo and Cr. From D16 toward D10, the hardness of the surface layer is increased, and the hardness is made uniform after having reached the martensite transformation structure zone.

Particularly at D10, the hardness of the surface layer was 400 Hv, and the hardness of the center layer was 350 Hv. This means that the fine ferrite structure is formed at the center layer.

The reason why the hardness is higher at a smaller diameter is that the deformation rate was increased in proportion to an increase in the rolling ratio and much potential was distributed at the surface layer and the center layer. Thereby, yield strength was increased.

Figure 6:
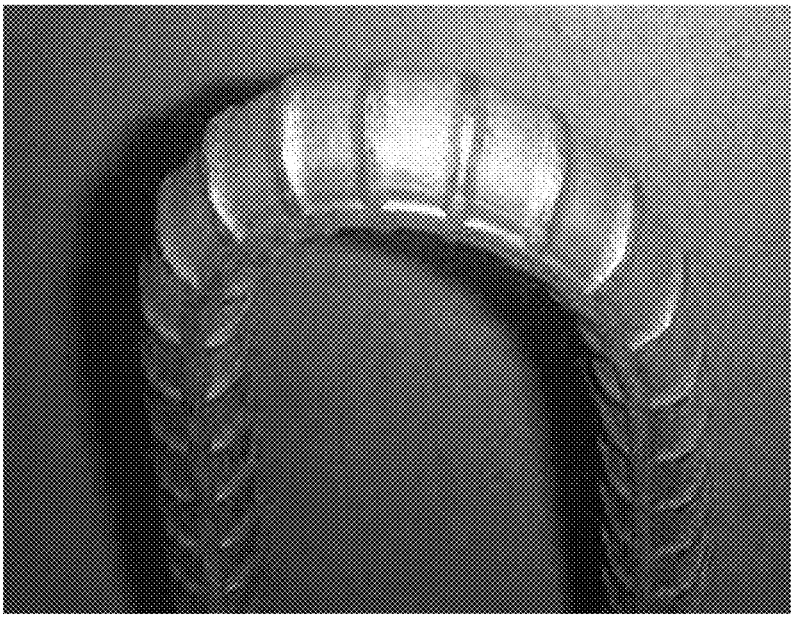
FIG. 6 illustrates a photograph of Example 2 of Table 2 rolled into D10 after bending performance testing.

FIG. 6 is a photograph illustrating Example 2 of Table 2 rolled into D10 after 180° bending performance testing.

As illustrated in FIG. 6, no crack was generated upon 180° bending testing. With reference to Table 2, in Example 2 rolled into D10, yield strength was 800 MPa or more, and in the case of equal to or greater than D10, yield strength of 800 MPa or less was obtained. Thereby, ultrahigh strength and ductility can be ensured at the same time.

Figure 7:
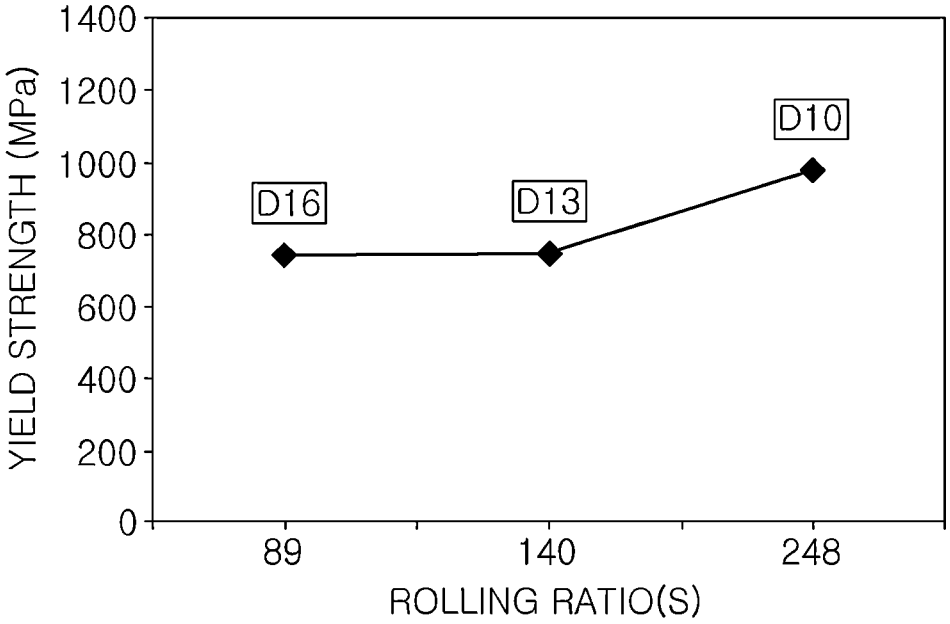
FIG. 7 is a graph illustrating the results of measuring changes in yield strength depending on the rolling ratio at different diameters.

FIG. 7 is a graph illustrating changes in yield strength depending on the rolling ratio at different diameters. (In FIG. 7, D16 corresponds to Example 6 (Class 6) of Table 2, D13 corresponds to Example 3 (Class 3) of Table 2, and D10 corresponds to Example 2 (Class 2) of Table 2.)

In order to evaluate whether any factor has a great influence on changes in yield strength among rolling conditions, changes in yield strength were measured depending on the rolling ratio under conditions of the rolling rate and the spraying rate being fixed at different diameters.

As illustrated in FIG. 7, at the rolling ratio 248 S (D10), yield strength was 800 MPa or more. The reason why the yield strength at D10 is higher than that at D13 or D16 is that the ferrite grain size is small and the martensite transformation structure is formed at the surface layer.

FIG. 8 is a graph illustrating changes in yield strength depending on the temperature of the Tempcore process.

As illustrated in FIG. 8, as the temperature of the Tempcore process decreases, yield strength increases. When the Tempcore process was performed at 463° C., higher yield strength was exhibited, compared to the other temperature ranges. This is because while steel bars rolled at a high temperature are forcibly cooled, martensite transformation takes place at the surface thereof, and as the diameter decreases, the effect thereof affects the microstructure of the center, so that the ferrite grains are made finer and the martensite transformation takes place.

Therefore, the microstructures of the surface layer and the center layer can be controlled via alloy designs containing Cr and Mo, a heat treatment process, the control of rolling ratio, a Tempcore process, etc., thereby obtaining ultra-high-strength steel bars which satisfy a yield strength of 800 MPa or more, a tensile strength of 900 MPa or more, an elongation percentage of 10% or more, and 180° bending testing.

The production of such ultra-high-strength steel bars can reduce material costs and construction costs upon constructing buildings, can maximize the volume ratio of buildings, and can achieve the slimness of members. Furthermore, the use of high-strength steel bars reduces the extent of arrangement thereof, making it possible to ensure desired quality due to good pouring of concrete.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method of manufacturing an ultra-high-strength steel bar, comprising:

subjecting a billet for a steel bar comprising C: 0.05 to 0.45 wt %, Si: 0.10 to 0.35 wt %, Mn: 0.1 to 0.85 wt %, Cr: 0.6 to 1.20 wt %, and Mo: 0.05 to 0.35 wt %, with a remainder being Fe and other impurities, to a hot rolling process in which reheating and rough milling are performed twice and then intermediate roll-milling and finishing roll-milling are performed to manufacture a steel bar, cooling the steel bar with water up to 400 to 600° C. through a Tempcore process, and performing air cooling on a cooling bed, wherein the hot rolling process comprises:

primary reheating including heating at 1000~1250° C. for 1~3 hr;

primary hot rolling including rough milling at 900~1000° C.;

secondary reheating including heating at 1100~1200° C. for 1~3 hr; and secondary hot rolling including rough milling, intermediate roll-milling, and finishing roll-milling at 800~900° C., wherein the steel bar has a surface layer and a center layer, wherein a martensite structure which is a hardening layer is formed at the surface layer and the center layer includes a ferrite structure, and wherein the steel bar has a diameter of 9.5~10.5 mm, the hardening layer has a depth of 0.8~2.3 mm from a surface toward a center, and the ferrite structure has a grain size of 5~7 μm and wherein the steel bar has a yield strength of 800 MPa or more, and a tensile strength of 900 MPa or more.

2. The method of claim 1, wherein the other impurities comprise P: 0.035 wt % or less but exceeding zero, Ni: 0.2 wt % or less but exceeding zero, Cu: 0.3 wt % or less but exceeding zero, V: 0.001 to 0.006 wt %, S: 0.075 wt % or less but exceeding zero, Al: 0.04 wt % or less but exceeding zero, Sn: 0.01 wt % or less but exceeding zero, and $N_2$: 150 ppm or less but exceeding zero.

3. The method of claim 1, wherein the Tempcore process is performed by spraying cooling water under conditions of a water pressure of 4~6 bar and a spraying rate of 400~600/hr so that the steel bar is cooled up to 400~600° C.

4. The method of claim 1, wherein the billet for the steel bar is manufactured by performing an electric furnace process, a ladle process, and a vacuum refining process thus preparing molten steel, feeding the molten steel into a mold from a tundish via stopper casting to prevent re-oxidation, and performing continuous casting.

5. The method of claim 1, wherein in the hot rolling process, a rolling ratio is controlled so that the steel bar has a diameter of 9.5~10.5 mm.

* * * * *